US005313140A

United States Patent [19]

Smith et al.

[11] Patent Number: 5,313,140

[45] Date of Patent: May 17, 1994

[54] FIELD EMISSION DEVICE WITH INTEGRAL CHARGE STORAGE ELEMENT AND METHOD FOR OPERATION

[75] Inventors: Robert T. Smith, Mesa; Lawrence Dworsky; Robert C. Kane, both of Scottsdale, all of Ariz.

[73] Assignee: Motorola, Inc., Schaumburg, Ill.

[21] Appl. No.: 7,880

[22] Filed: Jan. 22, 1993

[51] Int. Cl.[5] ..... G09G 3/10

[52] U.S. Cl. ..... 315/169.1; 315/169.3; 315/167; 315/172; 315/173

[58] Field of Search ..... 315/227 R, 169.1, 3, 315/169.3, 167, 172, 173

[56] References Cited

U.S. PATENT DOCUMENTS

| | | | |
|---|---|---|---|
| 4,908,539 | 3/1990 | Meyer | 315/169.1 X |
| 5,075,595 | 12/1991 | Kane | 315/169.1 X |
| 5,153,483 | 10/1992 | Kishino et al. | 315/169.1 X |
| 5,210,472 | 5/1993 | Casper et al. | 315/169.1 X |

*Primary Examiner*—Robert J. Pascal
*Assistant Examiner*—Reginald A. Ratliff
*Attorney, Agent, or Firm*—Gary F. Witting; Eugene A. Parsons

[57] ABSTRACT

Field emission device apparatus employing an integrally formed capacitance and a switch serially connected between a conductive element and a current source to provide substantially continuous emitted electron current during selected charging periods and non-charging periods.

8 Claims, 5 Drawing Sheets

FIELD EMISSION DEVICE WITH INTEGRAL CHARGE STORAGE ELEMENT AND METHOD FOR OPERATION

FIELD OF THE INVENTION

This invention relates generally to field emission devices and more particularly to microelectronic field emission devices employing integral charge storage elements and a method of operation.

BACKGROUND OF THE INVENTION

Microelectronic field emission devices are known in the art and typically comprise an electron emitter, for emitting electrons and an extraction electrode, for providing an electric field to the electron emitter to facilitate the emission of electrons. In some embodiments, field emission devices may also include an anode for collecting emitted electrons.

Operation of field emission devices typically includes operably coupling a voltage between the extraction electrode and a reference potential and operably connecting the electron emitter to the reference potential. Alternatively, the extraction electrode may be operably connected to a reference potential and a voltage may be operably coupled between the electron emitter and the reference potential. In order to effect modulated electron emission it is possible to provide an extraction electrode potential in concert with a variable electron emitter potential.

A common operational shortcoming of microelectronic field emission devices is that the electron emission occurs during the period of application of modulating signals only. Attempts to overcome this shortcoming have not been operationally enabling.

Accordingly, there exists a need to provide a field emission device apparatus which overcomes at least some of the shortcomings of the existing art.

SUMMARY OF THE INVENTION

It is one object of the present invention to provide an improved field emission device apparatus which employs integrally formed interelectrode capacitance as an electron emission enabling and storage means.

It is another object of the present invention to provide a field emission device apparatus comprised of an array of field emission devices wherein each field emission device of the array of field emission devices is in an ON mode substantially continuously during the time of operation of the apparatus.

This need, objects and others are substantially met by a method of operating field emission device apparatus including the steps of providing field emission device apparatus including a supporting substrate, a conductive element disposed on the supporting substrate, an insulator layer having a prescribed relative permittivity and resistivity disposed on the supporting substrate, a gate extraction electrode disposed on the insulator layer, an aperture defined through the gate extraction electrode and the insulator layer, an electron emitter, for emitting electrons, disposed on and operably coupled to the conductive element and disposed within the aperture, an integrally formed capacitance having a first conductor comprised of the gate extraction electrode and a second conductor comprised of the conductive element and the electron emitter, a switch operably coupled to at least the conductive element, an anode for collecting emitted electrons, a first potential source operably coupled between the anode and a reference potential, a second potential source operably coupled between the gate extraction electrode and the reference potential, a third potential source operably coupled between the switch and the reference potential, placing the switch in a low impedance (closed) mode for a charging period of time, providing a charging electron current to the integrally formed capacitance and an emitted electron current which is emitted from the electron emitter substantially from the third potential source, placing the switch in a high impedance (open) mode for a non-charging period of time, and providing the emitted electron current substantially from the charge stored at the integrally formed capacitance such that the emitted electron current is present during substantially the charging period and the non-charging period.

This need, objects and others are further met through a field emission device apparatus including a supporting substrate, a conductive element disposed on the supporting substrate, an insulator layer having a prescribed relative permittivity and resistivity disposed on the supporting substrate, a gate extraction electrode disposed on the insulator layer, an aperture defined through the gate extraction electrode and the insulator later, an electron emitter, for emitting electrons, disposed on and operably coupled to the conductive element and disposed within the aperture, an integrally formed capacitance having a first conductor comprised of the gate extraction electrode and a second conductor comprised of the conductive element and the electron emitter, and a switch operably coupled to at least the conductive element.

DETAILED DESCRIPTION OF THE DRAWINGS

Figure 1:
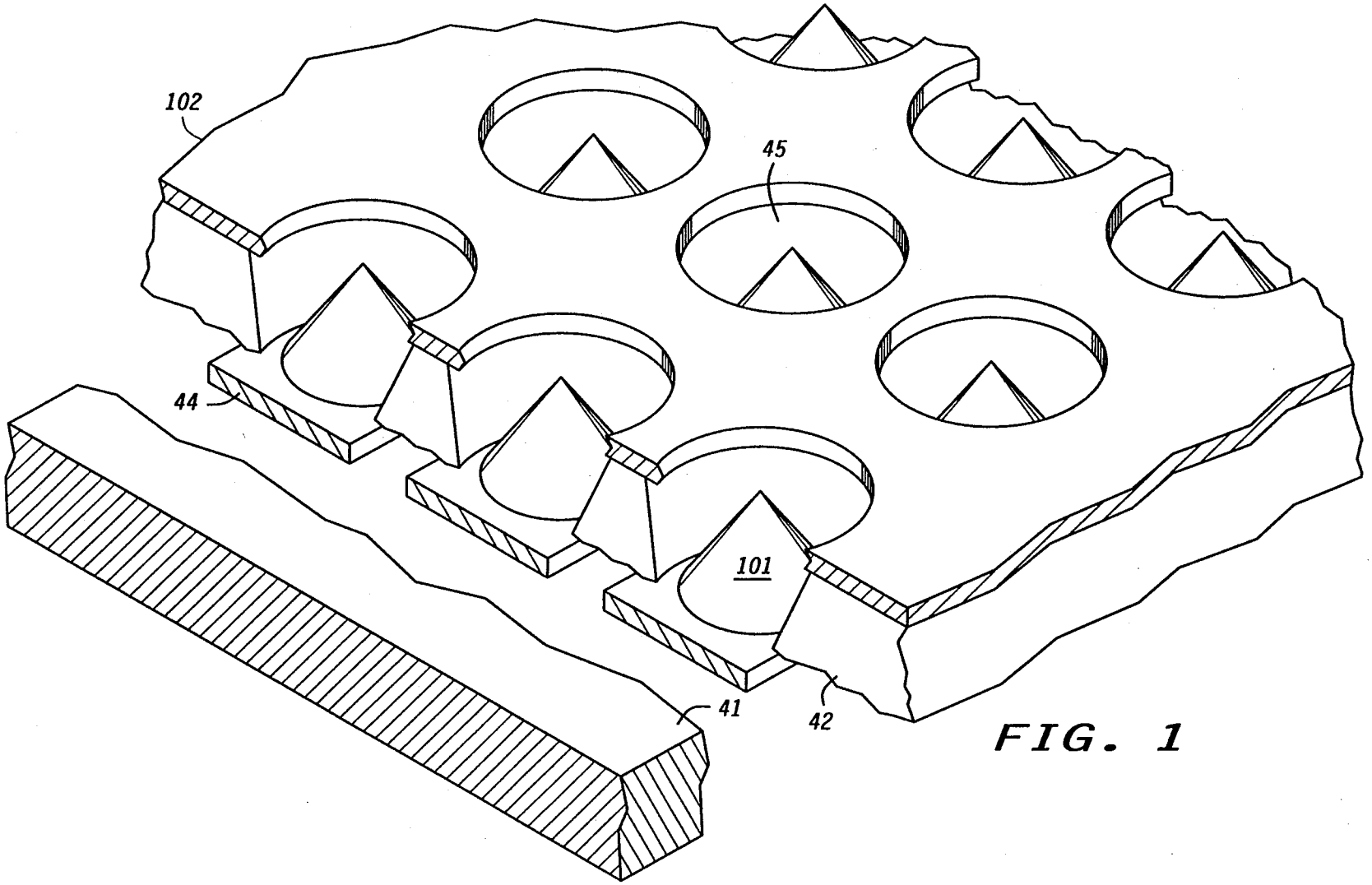
FIG. 1 is a perspective view of a portion of an array of field emission devices.

FIG. 1 is a perspective view of a portion of one embodiment of an array of field emission devices wherein a single gate extraction electrode 102 is common to each of a plurality of electron emitters 101. Gate extraction electrode 102 is shown disposed on an insulator layer 42 which insulator layer 42 is typically realized of material having prescribed electrical properties such as relative permittivity and resistivity. FIG. 1 further depicts a plurality of conductive elements 44 each of which is operably coupled to an electron emitter 101. For clarity a supporting substrate 41, on which embodiments of field emission devices are commonly disposed, is depicted in an exploded view. However, conductive element 44 and insulator layer 42 are typically disposed on supporting substrate 41. Gate extraction electrode 102 may be comprised of any of many materials including metallic conductors, such as molybdenum, nickel, niobium, tungsten, etc. and semiconductors, such as silicon, germanium, etc. Conductive elements 44 may also be comprised of one of conductive and semiconductor materials such as those described previously with reference to gate extraction electrode 102.

Each field emission device in the array of field emission devices depicted in FIG. 1 includes an electron emitter 101 disposed on and operably coupled to a conductive element 44 and substantially symmetrically within an aperture 45 defined through gate extraction electrode 102 and insulator layer 42. An integrally formed capacitance is associated with each field emission device of the array of field emission devices. The integrally formed capacitance is comprised of a first conductor which is extraction electrode 102 and a second conductor which is comprised of a conductive element 44 in concert with an electron emitter 101 disposed thereon and operably coupled thereto. It may be observed from FIG. 1 that the integral capacitance is further defined by the portion of insulator layer 42 disposed between gate extraction electrode 102 and conductive element 44 and a free-space region which exists between extraction electrode 102 and electron emitter 101.

Figure 2:
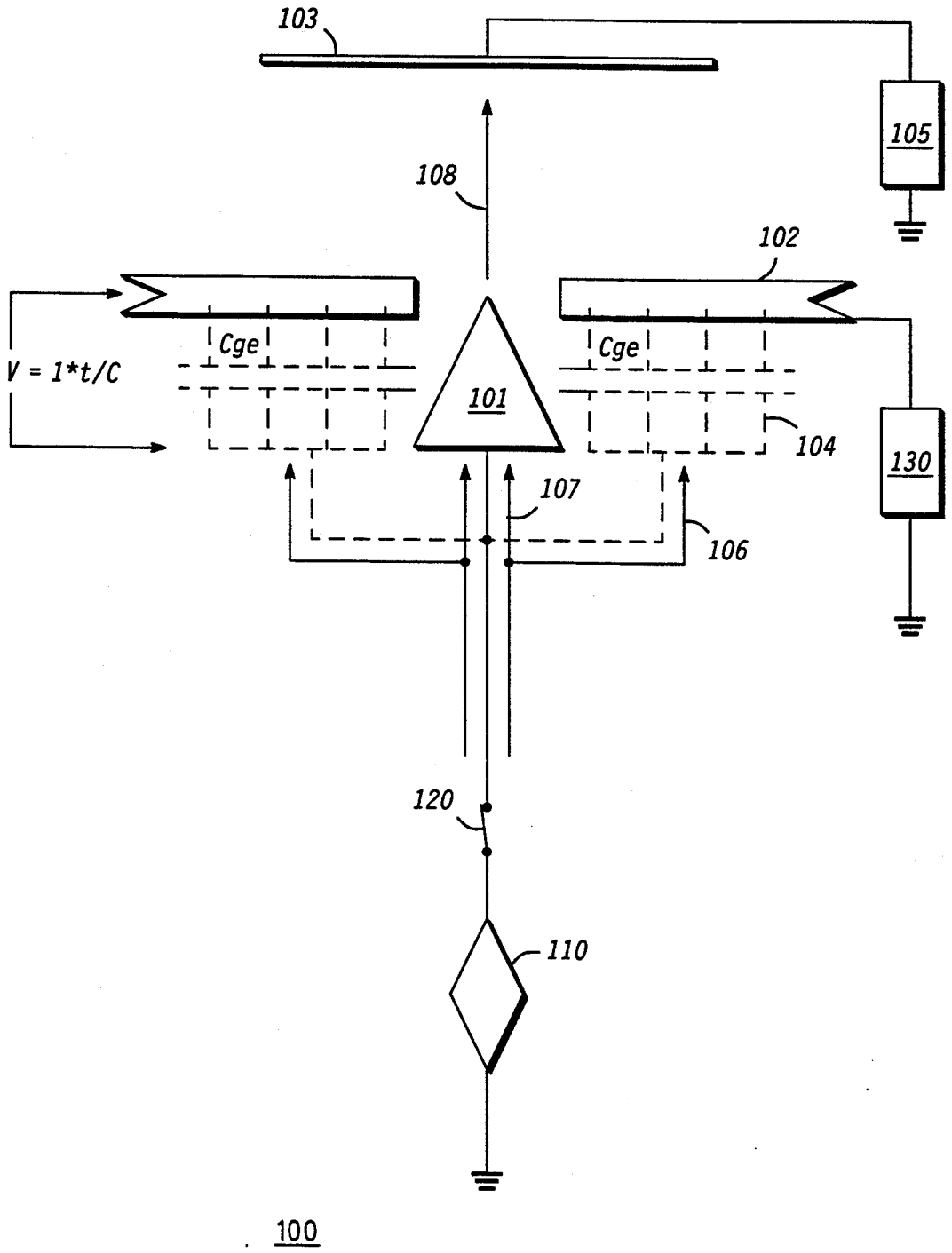
FIG. 2 is a first schematic representation of field emission device structure in accordance with the present invention.

FIG. 2 is a first schematic representation of a field emission device 100 and includes an electron emitter 101, for emitting electrons, a gate extraction electrode 102, and an anode 103 for collecting electrons. An integrally formed capacitance 104 is depicted in dashed line form to emphasize the importance of the fact that this is not a discrete circuit element and is realized by virtue of the physical structure of field emission device 100.

A potential source 105, which is typically an externally provided voltage source, is connected between the distally disposed anode 103 and a reference potential, such as ground. A potential source 130, which is typically an externally provided voltage source, is connected between gate extraction electrode 102 and the reference potential. An externally provided switch 120 is connected in series between electron emitter 101 and an externally provided source 110, which source 110 may be realized as, for example, a current source, voltage source, voltage controlled current source, or voltage controlled voltage source.

FIG. 2 further depicts a charging mode of operation wherein switch 120 is in a closed (low impedance) state. For example, if switch 120 is realized as a transistor device the transistor device will be in an ON mode to realize the low impedance state (mode). As such, source 110 provides a flow of charging current 106 through switch 120 to deposit electrons onto capacitance 104. Source 110 assumes a desired terminal voltage as required to deliver a pre-determined charge to capacitance 104. As capacitance 104 charges, a voltage, described by the relationship $V=Q/C$ ($V=I*t/C$), exists between gate extraction electrode 102 and electron emitter 101.

Recall from the description of the embodiment depicted in FIG. 1 that the electron emitter may be disposed on a conductive element. For the purposes of the operational description of FIG. 2 it is assumed that the depicted electron emitter 101 also represents any conductive element to which electron emitter 101 is coupled and which may comprise a part of the second conductor of capacitance 104.

Returning now to the operational description of field emission device 100, it is shown that as the voltage between gate extraction electrode 102 and electron emitter 101 rises (as a result of the increasing charge on capacitance 104) an emission current 107 begins to flow into electron emitter 101 and becomes an emitted electron current 108.

Figure 3:
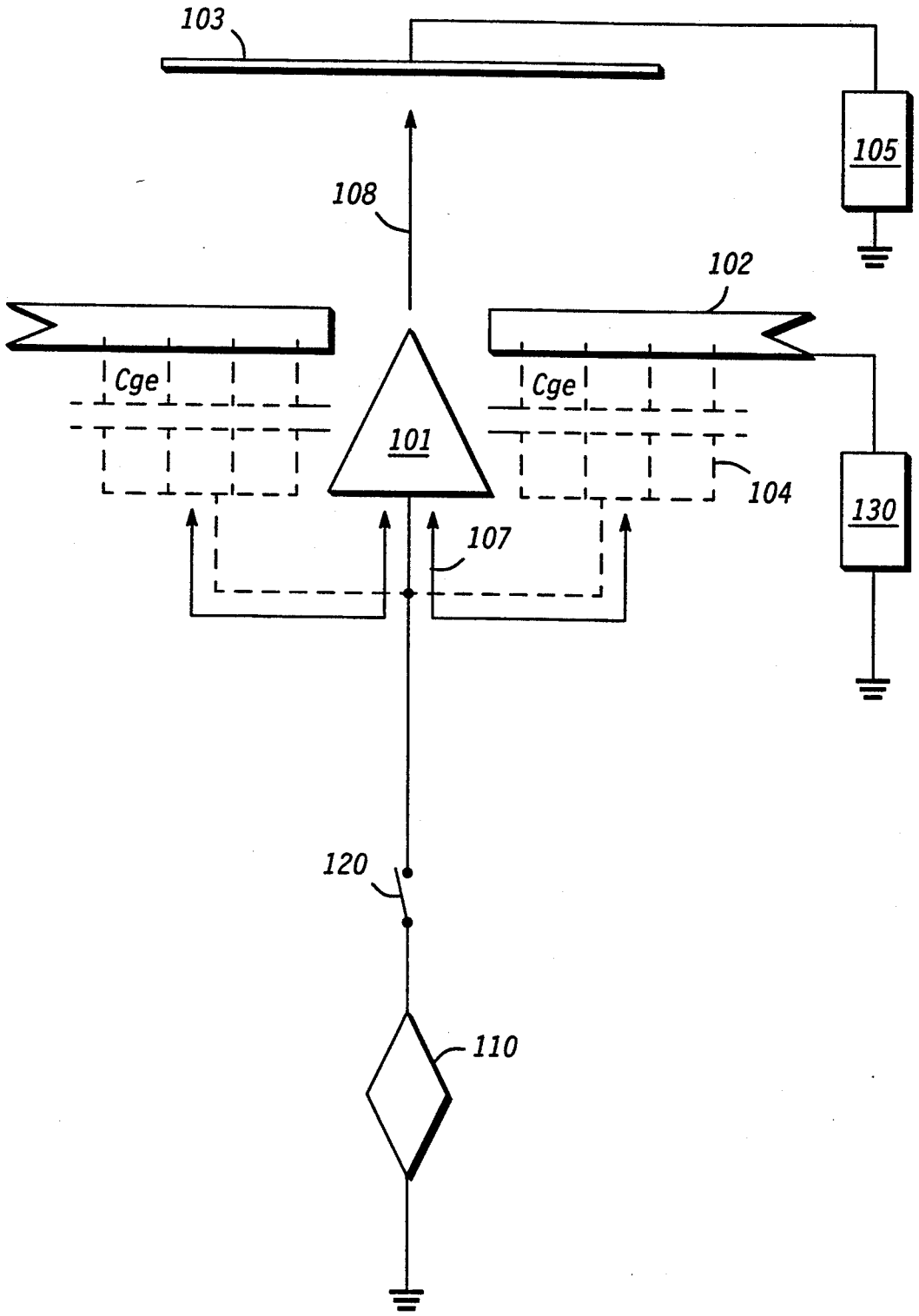
FIG. 3 is a second schematic representation of the structure of FIG. 2.

FIG. 3 is a second schematic representation of field emission device 100 wherein switch 120 is depicted in an open (high impedance) mode (state) such as that which may be realized by a transistor in an OFF mode. In the off mode, electron emitter 102 and associated capacitance 104 are isolated from source 110. However, due to the electron charge previously stored on the second conductor of capacitance 104 the voltage between gate extraction electrode 102 and electron emitter 101 remains. The voltage between extraction electrode 102 and electron emitter 101 provides for continued emitted electron current 108 which is supplied by the stored electron charge.

Over a finite time interval, as charge is released to provide the emitted electron current 108 the voltage between extraction electrode 102 and electron emitter 101 will be reduced, which serves to reduce emitted electron current 108. Therefore, as less electron charge is available (over a time interval) less electron charge is demanded.

Figure 4:
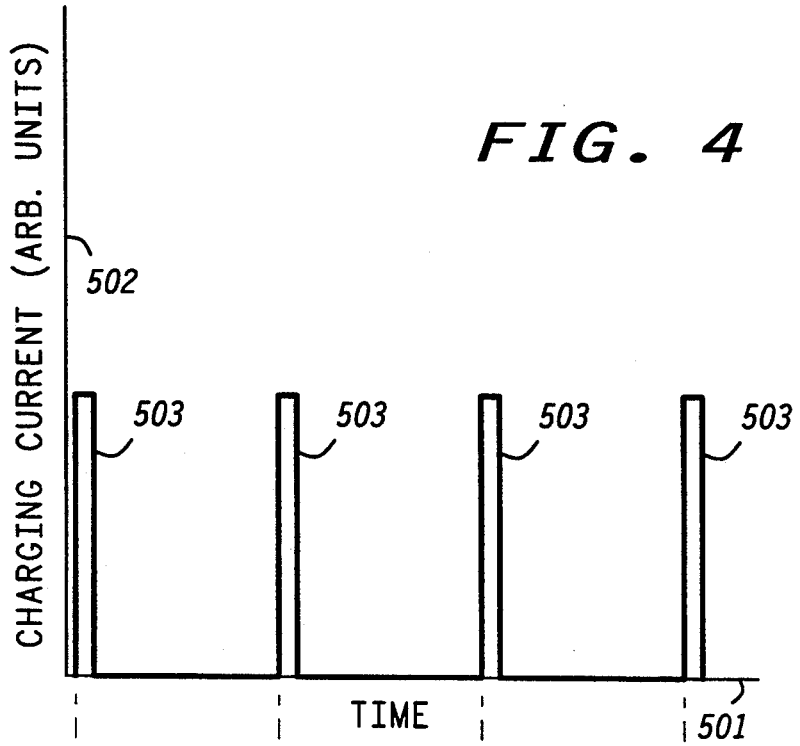
FIG. 4 is a graphical representation of charging current vs. time in the structure of FIG. 2.

FIG. 4 is a graphical representation of a number of arbitrary charging periods of time (described previously with reference to FIG. 2), which are on the order of approximately 1.0 to 10.0 μsec. The charging periods are designated 503 and finite intervals of non-charging periods of time, which may be on the order of approximately 0.1 to 100 msec., exist therebetween. An ordinate 501 represents time and an abscissa 502 represents an arbitrary charging current 106. Charging periods 503 depict that a charging current 106 is provided for a determined period of time at recurring intervals.

Figure 5:
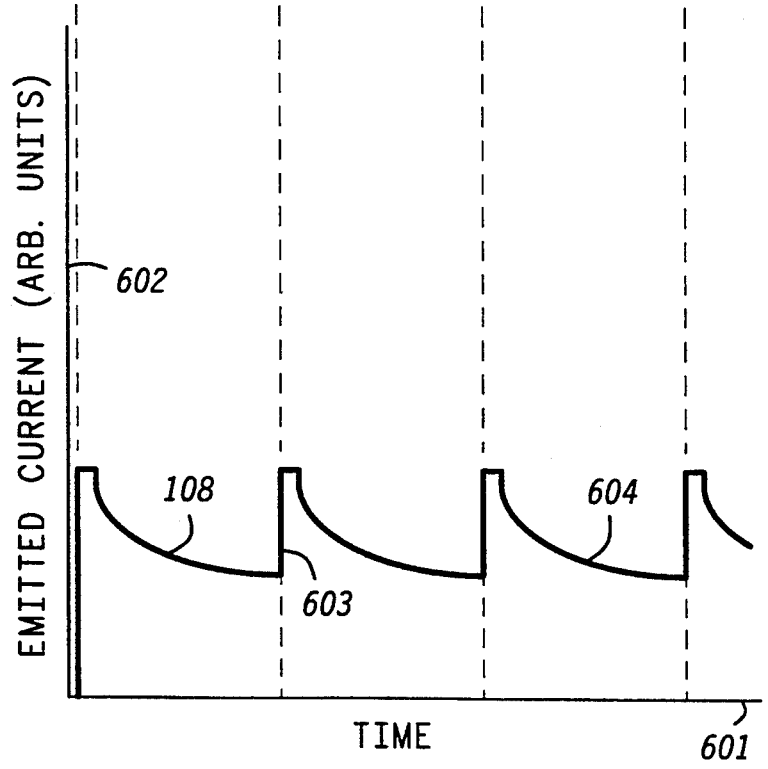
FIG. 5 is a graphical representation of electron emission current vs. time in the structure of FIG. 2.

FIG. 5 is a graphical representation of emitted electron current 108, described previously with reference to FIGS. 2 and 3 and having a time relationship substantially corresponding to that depicted previously with reference to FIG. 4. An ordinate 601 represents time and an abscissa 602 represents an arbitrary emitted electron current. A time correspondence is depicted (dashed lines) between FIGS. 4 and 5 which defines that a maximum emitted electron current 603 occurs substantially during the charging period of time 503 and that a decreasing emitted electron current 604 persists during the non-charging (non-selected) period of time which corresponds substantially to the high impedance mode (open) of switch 120, depicted in FIG. 3.

Figure 6:
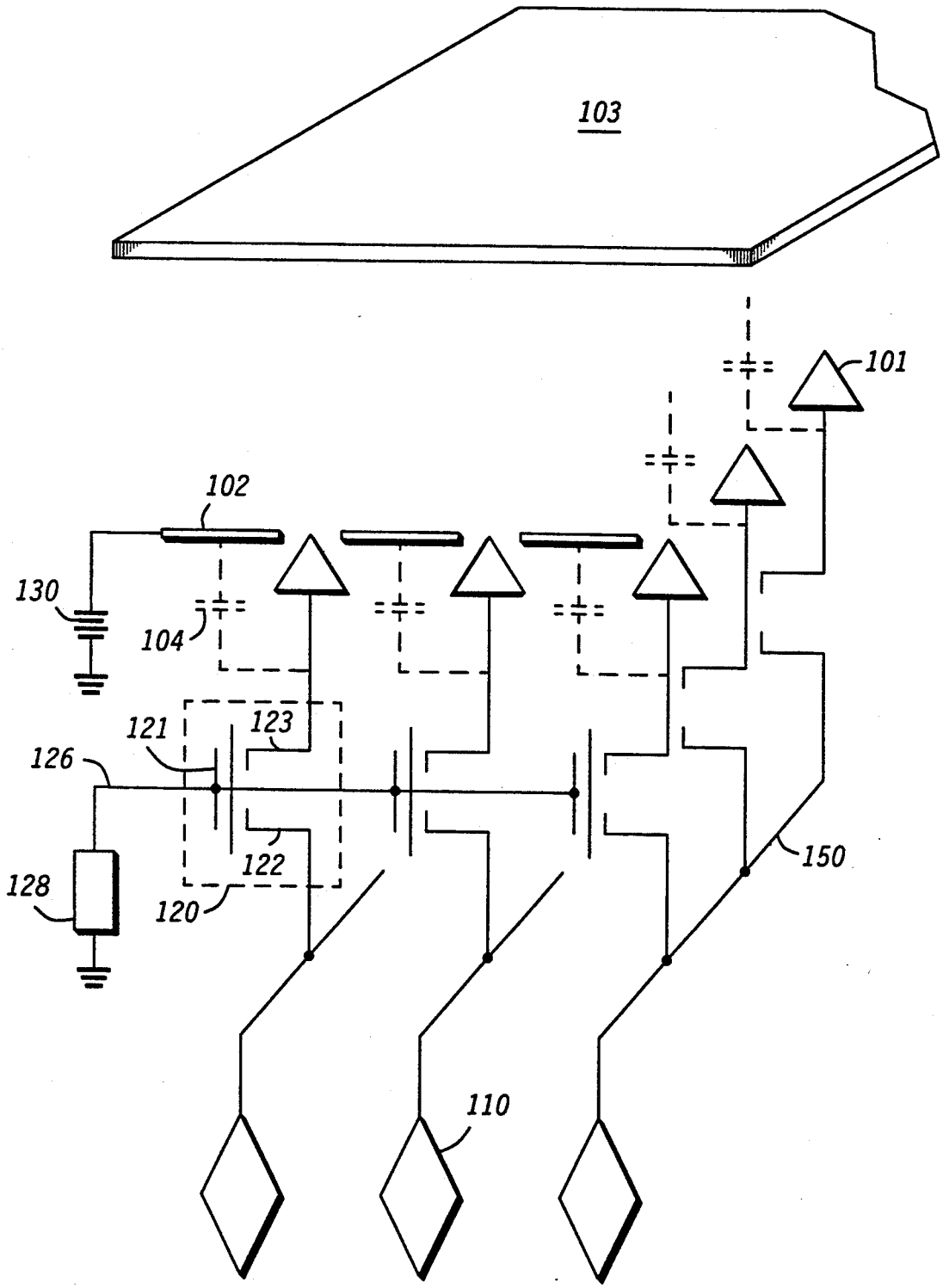
FIG. 6 is a schematic representation of a portion of an array of field emission devices in accordance with the present invention.

FIG. 6 is a schematic representation of a portion of an array of field emission devices in accordance with the present invention as described previously with respect to FIGS. 2 and 3 and as described operationally with respect to FIGS. 4 and 5. A plurality of switches 120 (depicted within a dashed line box), each including a transistor drain 123, a transistor source 122, and a transistor gate 121, are each serially connected between an electron emitter 101 of each field emission device and a conductor line 150 of a plurality of conductive lines. Each gate 121 of a row of switches 120 is operably connected to a select line 126. A potential source 128, typically comprised of an externally provided voltage source, is operably selectively connected to select line 126. When a voltage from source 128 is applied to select line 126, each switching means 120 associated with select line 126 is placed in the low impedance (closed) mode (state) to allow a charging current (described previously) to charge associated integrally formed capacitances 104 by virtue of source 110 operably coupled to each conductive line 150.

After the charge period, source 128 is removed to place associated switches 120 in the high impedance (open) mode and the operation of the row of field emission devices continues as described previously with reference to FIG. 3. A sequential progression of charging periods by periodically sequentially applying the voltage of source 128 to each of a plurality of rows provides for substantially continuous operation (emitted current) of each of the field emission devices of the array of field emission devices.

It should be noted for the purposes of this disclosure that when a single field emission device electron emitter is depicted as operably coupled to one conductive element it is anticipated that a plurality of field emission device electron emitters may be similarly operably coupled to the one conductive element and that embodiments employing such pluralities of coupled electron emitters are anticipated.

Thus, improved field emission device apparatus employing integrally formed interelectrode capacitance as an electron emission enabling and storage means is disclosed. Also, field emission device apparatus including an array of field emission devices wherein each field emission device of the array of field emission devices is in an ON mode substantially continuously during the time of operation of the apparatus is disclosed.

What is claimed is:

1. A field emission device apparatus comprising:

a supporting substrate;

a conductive element disposed on the supporting substrate;

an insulator layer having a prescribed relative permittivity and resistivity disposed on the supporting substrate;

a gate extraction electrode disposed on the insulator layer;

an aperture defined through the gate extraction electrode and the insulator layer;

an electron emitter, for emitting electrons, disposed on and operably coupled to the conductive element and disposed within the aperture;

an integrally formed capacitance having a first conductor comprised of the gate extraction electrode and a second conductor comprised of the conductive element and the electron emitter;

a switch operably coupled to at least the conductive element an anode for collecting the emitted electrons;

a first potential source operably coupled between the anode and a reference potential;

a second potential source operably coupled between the gate extraction electrode and the reference potential;

a controlled current source operably coupled between the switch and the reference potential.

2. A field emission device apparatus comprising:

a plurality of field emission devices each including a supporting substrate, a conductive element disposed on the supporting substrate, an insulator layer disposed on the supporting substrate, a part of a gate extraction electrode disposed on the insulator layer, an aperture defined through the part of the gate extraction electrode and the insulator layer, an electron emitter disposed on and operably coupled to the conductive element and in the aperture, an integral capacitance defined by a first conductor comprised of the part of the gate extraction electrode and a second conductor comprised of the conductive element and the electron emitter; and a plurality of switches each operably coupled to at least the conductive element of a field emission device of the plurality of field emission devices.

an anode for collecting the emitted electrons;

a first potential source operably coupled between the anode and a reference potential;

a second potential source operably coupled between the gate extraction electrode and the reference potential; and a plurality of controlled current sources each operably coupled between a switch of the plurality of switches and the reference potential.

3. A method of operating field emission device apparatus including the steps of:

providing field emission device apparatus including a supporting substrate, a conductive element disposed on the supporting substrate, an insulator layer having a prescribed relative permittivity and resistivity disposed on the supporting substrate, a gate extraction electrode disposed on the insulator layer, an aperture defined through the gate extraction electrode and the insulator layer, an electron emitter, for emitting electrons, disposed on and operably coupled to the conductive element and disposed within the aperture, an integrally formed capacitance having a first conductor comprised of the gate extraction electrode and a second conductor comprised of the conductive element and the electron emitter, a switch operably coupled to at least the conductive element, an anode for collecting emitted electrons, a first potential source operably coupled between the anode and a reference potential, a second potential source operably coupled between the gate extraction electrode and the reference potential, and a controlled current source operably coupled between the switch and the reference potential;

placing the switch in a low impedance mode for a charging period of time;

providing a charging electron current to the integrally formed capacitance and an emitted electron current which is emitted from the electron emitter substantially from the controlled current source;

placing the switch in a high impedance mode for a non-charging period of time; and providing the emitted electron current substantially from the charge stored at the integrally formed capacitance, such that the emitted electron current is present during substantially the charging period and the non-charging period.

4. A method as claimed in claim 3 wherein the charging period is on the order of approximately 1.0 to 10.0 μsec.

5. A method as claimed in claim 3 wherein the non-charging period is on the order of approximately 0.1 to 10.0 msec.

6. A method of operating field emission device apparatus including the steps of:

providing field emission device apparatus including a plurality of field emission devices each of which includes a supporting substrate, a conductive element disposed on the supporting substrate, an insulator layer having a prescribed relative permittivity and resistivity disposed on the supporting substrate, a part of a gate extraction electrode disposed on the insulator layer, an aperture defined through the part of the gate extraction electrode and the insulator layer, an electron emitter, for emitting electrons, disposed on and operably coupled to the conductive element and disposed within the aperture, an integrally formed capacitance having a first conductor comprised of the part of the gate extraction electrode and a second conductor comprised of the conductive element and the electron emitter, and a switch operably coupled to at least the conductive element, an anode for collecting electrons emitted by each electron emitter of the plurality of field emission devices, and a first potential source operably coupled between the anode and a reference potential, a second potential source operably coupled between the reference potential and each of the gate extraction electrodes of the plurality of field emission devices, and a plurality of third sources each operably coupled between the switch of at least some of the plurality of field emission devices and the reference potential;

placing the switch of at least some of the field emission devices in a low impedance (closed) mode for a charging period of time;

providing a charging electron current to the integrally formed capacitance and an emitted electron current, which is emitted from the electron emitter, to at least some of the field emission devices corresponding to the field emission devices to which the switch placed in the low impedance mode is operably coupled substantially from an associated third source of the plurality of third sources;

placing the switch of the at least some of the field emission devices in a high impedance (open) mode for a noncharging period of time; and providing the emitted electron current substantially from the charge stored at the integrally formed capacitance of the at least some of the field emission devices during the non-charging period of time, such that the emitted electron current is present during substantially the charging period and the non-charging period.

7. A method as claimed in claim 6 wherein the charging period is on the order of approximately 1.0 to 10.0 μsec.

8. A method as claimed in claim 6 wherein the non-charging period is on the order of approximately 0.1 to 10.0 msec.

* * * * *